US005676329A

United States Patent [19]

Bertoli et al.

[11] Patent Number: 5,676,329

[45] Date of Patent: Oct. 14, 1997

[54] METHOD FOR THE AUTOMATIC REGULATION OF THE THREAD TENSION IN A BOBBIN-WINDING MACHINE

[75] Inventors: Luciano Bertoli, Fiume Veneto; Nereo Marangone; Roberto Badiali, both of Pordenone, all of Italy

[73] Assignee: Savio Macchine Tessili S.r.l., Pordenone, Italy

[21] Appl. No.: 792,704

[22] Filed: Jan. 29, 1997

Related U.S. Application Data

[63] Continuation of Ser. No. 478,621, Jun. 7, 1995, abandoned.

[30] Foreign Application Priority Data

Jul. 6, 1994 [IT] Italy ..... MI94A1404

[51] Int. Cl.[6] ..... B65H 59/22; B65H 59/38; B65H 63/00

[52] U.S. Cl. ..... 242/413.9; 242/18 R; 242/36; 242/150 M; 242/419.4

[58] Field of Search ..... 242/18 R, 36, 242/413.9, 419, 419.2, 419.4, 150 M

[56] References Cited

U.S. PATENT DOCUMENTS

| | | | |
|---|---|---|---|
| 2,190,261 | 2/1940 | Feaster . | |
| 2,253,521 | 8/1941 | Hitchcock . | |
| 2,732,142 | 1/1956 | Grein | 242/419.2 |
| 3,494,564 | 2/1970 | Lindemann et al. | 242/419.2 |
| 4,650,133 | 3/1987 | White et al. | 242/36 X |
| 4,768,728 | 9/1988 | Jenny et al. | 242/36 X |
| 4,828,191 | 5/1989 | Ruge et al. | 242/18 R |
| 4,880,175 | 11/1989 | Yamauchi et al. | 242/36 X |
| 4,984,749 | 1/1991 | Matsui et al. | 242/36 X |
| 5,046,673 | 9/1991 | Moussalli | 242/150 M X |

FOREIGN PATENT DOCUMENTS

| | | |
|---|---|---|
| 0 311 815 | 4/1989 | European Pat. Off. . |
| 3812449 A1 | 3/1988 | Germany . |
| 3904065 A1 | 8/1989 | Germany . |

*Primary Examiner*—Michael Mansen

*Attorney, Agent, or Firm*—Oblon, Spivak, McClelland, Maier & Neustadt, P.C.

[57] ABSTRACT

A method for automatically regulating a thread tension in a bobbin-winding machine having a lower pirn, an upper bobbin, and thread-tension devices, wherein during the entire time thread unwound from the lower pirn is collected on the upper bobbin in formation, the thread-tension devices press on the thread between the lower pirn and the upper bobbin with a pressure action controlled on the basis of a winding speed value of the thread.

5 Claims, 2 Drawing Sheets

METHOD FOR THE AUTOMATIC REGULATION OF THE THREAD TENSION IN A BOBBIN-WINDING MACHINE

This application is a continuation of application Ser. No. 08/478,621, filed on Jun. 7, 1995, now abandoned.

BACKGROUND OF THE INVENTION

1. Field of the Invention

The invention relates to a method for an automatic regulation of a thread tension in a bobbin-winding machine and this regulation acts on pre-established winding-speed values, at each moment, in various thread-collection phases.

2. Discussion of the Background

As is known, winding devices are used in a textile industry to wind a thread onto suitable bobbins, example of cylindrical or flat-tapered cross-wound bobbins. These winding devices, known as bobbin-winding machines, have a capacity of winding thread at a high speed which is unwound from a lower pirn and collected on an upper bobbin in formation.

Some textile processes include a step of transferring the thread, at the highest possible speed, from one unit to another. For example a thread produced in a spinning machine, particularly a ring spinning machine, is normally wound onto a bobbin. In bobbin-winding there is, in fact, a transfer of the thread (rewinding) from the lower pirn to the upper bobbin, with an unwinding through axial extraction of the thread from the fixed pirn. In this case the thread is elongated and in relation to this elongation a thread tension is established. In accordance the continuous increase in the transfer speed of the thread (thread length transferred per unit time) to reduce production costs, higher tensions are created in the tread. Therefore, breakages occurs frequently, and thus operating performance and productivity of the bobbin-winding machine are lowered. Thread breakage occurs in fact under a tension which is greater than the tensile strength of the thread. It is also well-known to experts in the field, that the thread tension must remain substantially constant to ensure that difficulties do not arise during further textile operations of the bobbin namely the objective is always to obtain units of wound thread which are more suitable for subsequent operations such as dyeing, warping, picking, etc . . .

An increase in the bobbin circumferential speed of the wound thread creates a greater thread tension whereas a reduction in the circumferential speed produces a less thread tension.

For this reason the multiplication ratio is preferably made variable in both directions. It is therefore advantageous that the preregulated and prefixed winding-speed values are made to depend on the quantity of thread wound on the single lower pirn, on the degree of fullness of the bobbin in formation and also on the type of thread being wound, and other factors. In traditional bobbin-winding machines, however, there is no possibility of continually regulating the tension of the thread which is being wound onto the bobbin.

As a result, the thread itself may undergo excessive pull which can lead to its breakage. For the same reason also the winding of the thread onto the bobbin will not be regulated.

SUMMARY OF THE INVENTION

The above practical drawbacks are, instead, eliminated by the method to which the present invention relates. This method, in fact, provides an automatic regulation of the tension and this regulation is obtained by the fact that the thread tension is automatically and continuously checked and regulated by the pressing action of thread tension devices. These devices operate on the thread in relation to the pre-established winding-speed values at each moment during the various thread-collection phases onto the bobbin in formation. For the practical embodiment of the method of the invention, the pressure of the thread tension devices has opposite values to the variation of winding-speed values of the thread onto the bobbin in formation. According to another practical embodiment of the method of the present invention, it is established that the stretches; increasing winding-speed correspond to stretches of decreasing pressure values of the thread-tension devices and the stretches of decreasing winding-speed ding-speed correspond to stretches of increasing pressure values of the thread-tension devices. In the same way, the stretches of constant winding-speed correspond to basically constant pressure values of the thread-tension devices.

These and other operating characteristics of the method, to which the present patent invention relates, can be better understood with the help of the figures in the enclosed drawings.

DESCRIPTION OF THE PREFERRED EMBODIMENTS

In the figures, equal elements with equal or equivalent functions are shown by equal references.

Also in the figures, to clarify the group of parts which are not necessary for understanding the invention, such as operating and functional groups along the thread run, the various support structures of the bobbin-winding machine, the motorization centres and feeding, support and pirn expulsion devices, have been omitted.

Figure 1:
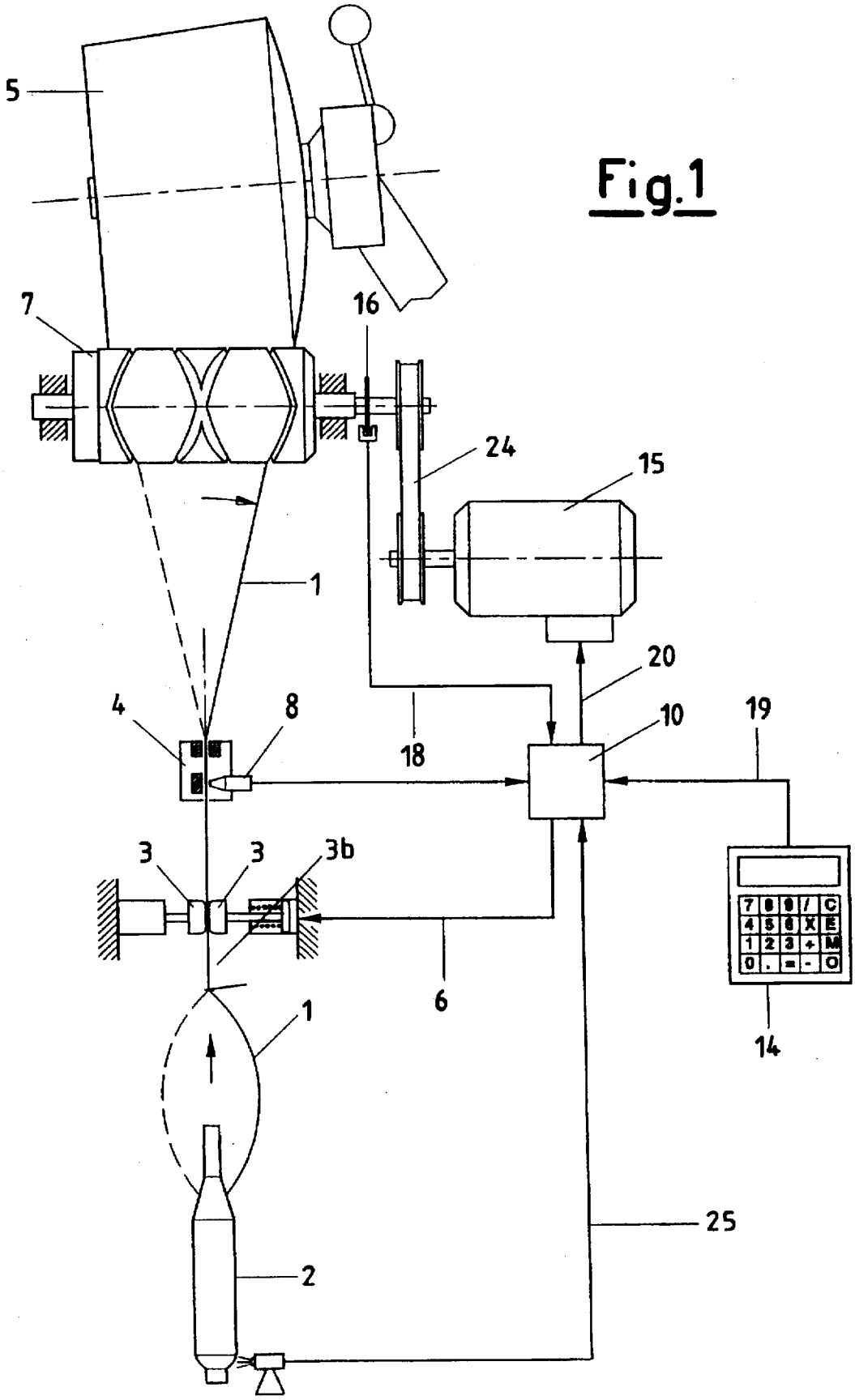
FIG. 1 is a schematic front view of the bobbin-winding machine with the thread-tension devices acting on the thread with pressure values depending on the winding-speed value.

Referring to Figures 1 is a thread which is unwound from a lower pirn 2 and which runs upwards to be wound in crossed coils around a bobbin 5 information 15 is a three-phase motor, or similar motor source, which activates, by means of a toothed belt 24, a thread-guide cylinder 7. The latter is a known driving roller which provides both alternating coming and going movement of the thread 1, and rotating movement of the bobbin 5 in formation until the latter has reached the required diameter of thread; 10 is a control block based on a microprocessor or an electronic card suitable for memorizing operating instructions. More specifically, these instructions are inserted by a key-board 14 through a cable 19. The control block 10 is programmed to transform these instructions coming from the cable 19 into a suitable program to be followed in its processing center to provide, at each moment, the necessary signals for a correct winding.

The control block 10 is in fact basically a microprocessor, which uses input information obtained both from a diskprobe 16 by means of a cable 18 and a probe 8. The probe 8 transmits signals programmed for the control of the thread 1 which is subjected to exploration by means of a block 4. The block 4 represents an electronic yarn cleaner. A photocell detects the presence of the minimum terminal quantity of thread wound onto pirn 2. The signal output by the photocell is transmitted to the control block via a cable 25. In relation to the minimum quantity, the photocell of cable 25 sends an electric signal to control the block 10 to establish the signals for driving the motor 15 via a cable 20 to adjust the winding speed to a value which does not damage the thread 1 being rapidly wound onto the surface of bobbin 5. There are three thread-tension devices in the known art, in particular clutch components which press, with varying pressure force, the thread 1 being wound. More specifically, the pressure variation of the 3 clutch components is activated with electric signals coming from the control block 10 through a cable 6, and these electric signals preferably activate an electromagnetic activator which pilots and regulates the action of the 3 clutch components with precise pressure values on the thread 1 which is rapidly wound. The following operational description, with reference to the figures mentioned above, refers to the whole group of devices and components which embody the method of the present invention and the function can be easily understood by observing the figures. In a textile winding machine, for example in an automatic bobbin-winding machine, thread 1 removed from pirn 2 which is being unwound is collected onto a crossed coil bobbin 5 and in this form it is suitable for use in subsequent operations.

As the thread is being transferred from the pirn 2 to the bobbin 5, the thread itself is subjected to exploration by the block 4, which represents the electronic yarn cleaner.

When the driving thread-guide cylinder 7 is the in a resting position, the three-phase motor source 15 is mechanically stopped and does not receive electrical energy.

When the function of the driving thread-guide cylinder 7 is required to begin winding, the following phases take place. The starting signal is sent to the motor source 15 from the control block 10 via the cable 20. The control block 10 has the whole operating cycle programmed in its memory. The motor source 15 starts rotating the probe-disk 16 and the guide roller 7 by means of the toothed-belt 24.

Figure 2:
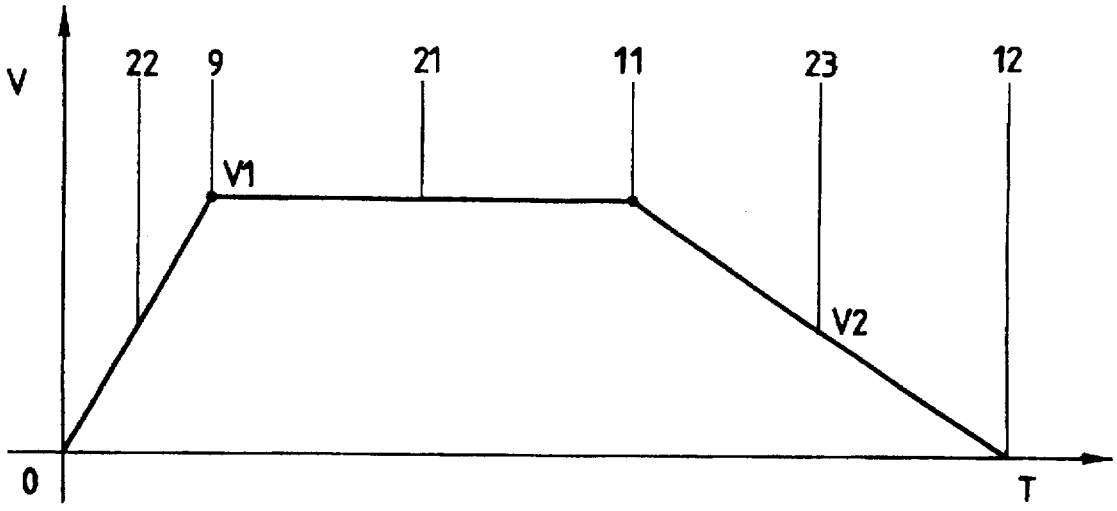
FIG. 2 is a shows the graph of the winding-speed along a stretch ranging from zero to standard speed, a stretch of constant standard speed and a slow-down stretch from standard to zero speed.
Figure 3:
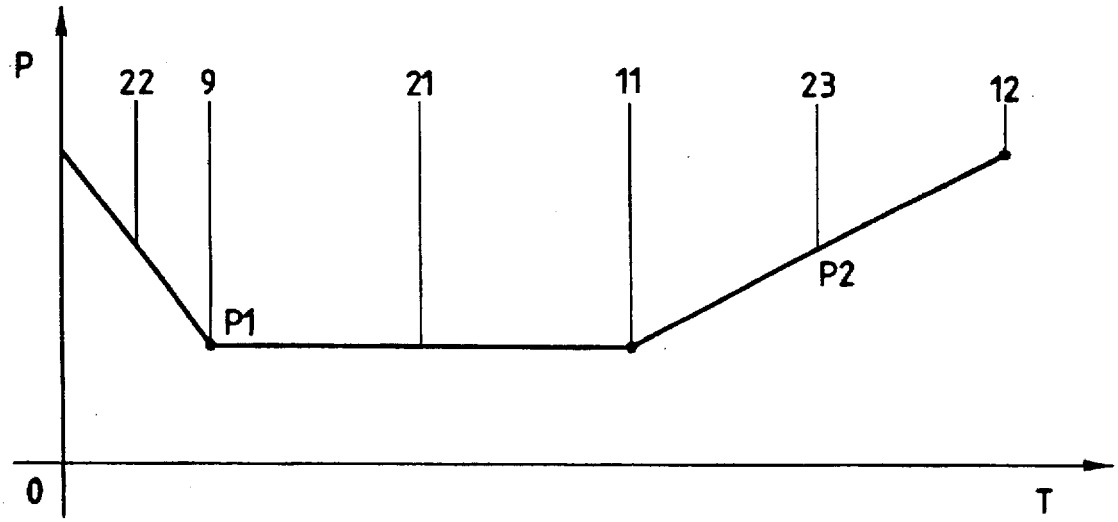
FIG. 3 is a shows the graph of the pressure values on the thread of the thread-tension devices and these pressure values are in relation to the speed values of FIG. 2.

The speed probe 16 supplies the central block 10 through the connecting cable 18, at each moment, with the instantaneous speed values which may be in acceleration phase 22, standard phase 21, or slow-down phase 23 in FIG. 2. The central control block 10 provides, through appropriate elaborations, by means of the connecting cable 6, the driving signals to pilot, at each moment, the threadtension device activator 3, in order to obtain a perfect harmony between the instantaneous speed values of FIG. 2 and the pressure values of the threadtension devices 3 of FIG. 3. In this way it is possible to follow with precision the correspondence of points 9, 11 and 12 and respective phases or stretches 22, 21 and 23 in both graphs of FIG. 2 and FIG. 3. More specifically, the interruption of lines of FIG. 3 is programmed and memorized, through the key-board 14, in the control block 10, and the pressure values on the thread by means of the thread-tension devices 3 are in relation to the corresponding instantaneous speed values detected by the probe 16 and transmitted by the cable 18 of the block 10.

The latter, as a central unit having the whole programmed operating winding cycle in its memory, sends preselection signals of accelerations and speeds to be obtained, at each moment, during the whole formation cycle of the bobbin 5. The central block 10 compares the preselection signal sent to the motor source 15 with the instantaneous speed value sent from the probe 16 and, with appropriate elaborations, supplies, through the cable 6, signals of the correct functioning of the activator of the thread-tension devices 3 which are pressing on the thread by a value which depends on the winding speed of the thread itself.

A description has been given of a preferred embodiment with some variations. It is evident, however, that other forms of embodiment are possible which enter into the spirit and scope of the present invention.

In this way, as the activating devices may vary so is it also possible to combine or remove operating units on the single or group of winding stations to advantageously co-ordinate all units in the various operating and control phases of the relation between the pressure values of the thread-tension devices 3 and the winding speed values.

These and other variations are consequently possible without leaving the range of the invention.

We claim:

1. A method for automatically regulating a thread tension in a bobbin-winding machine having a lower pirn, an upper bobbin, a thread winding speed detector, and thread-tension devices, said method comprising the steps of:

collecting thread unwound from said lower pirn on said upper bobbin in formation;

detecting a winding speed value of the thread by the thread winding speed detector;

controlling said winding speed value of the thread on the basis of said detected winding speed value by the thread winding speed detector;

pressing on the thread by said thread-tension devices between said lower pirn and said upper bobbin; and controlling a pressure action on said thread by said thread-tension devices on the basis of said detected winding speed value of the thread during an entire period of thread collection so as to regulate the thread tension.

2. A method according to claim 1, wherein the step of controlling said winding speed value includes the steps of increasing and decreasing said winding speed value, and the step of controlling said pressure action includes the steps of, increasing a pressure value by said thread-tension devices in accordance with a decrease of said detected winding speed value, and decreasing said pressure value in accordance with an increase of said detected winding speed value.

3. A method according to claim 2, wherein said pressure action is controlled such that stretches of decreasing pressure value of said thread-tension devices correspond to stretches of increasing said winding speed value and stretches of increasing pressure value of said thread-tension devices correspond to stretches of decreasing said winding speed value.

4. A method according to claim 1, wherein the step of controlling said winding speed value includes the steps of increasing and decreasing said winding speed value, and said pressure action is controlled such that stretches of decreasing pressure value of said thread-tension devices correspond to stretches of increasing said winding speed value and stretches of increasing pressure value of said thread-tension devices correspond to stretches of decreasing said winding speed value.

5. A method according to claim 1, wherein the step of controlling said winding speed value includes a step of maintaining said winding speed value at a constant value, the step of controlling said pressure action including a step of maintaining a pressure value by said thread-tension devices at a constant value, and stretches of said constant value of said winding speed value correspond to stretches of said constant value of said pressure value.

* * * * *